US006544409B2

(12) United States Patent
De Souza

(10) Patent No.: US 6,544,409 B2
(45) Date of Patent: Apr. 8, 2003

(54) PROCESS FOR THE CATALYTIC OXIDATION OF SULFUR, NITROGEN AND UNSATURATED COMPOUNDS FROM HYDROCARBON STREAMS

(75) Inventor: Wladmir Ferraz De Souza, Rio de Janeiro (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 1 day.

(21) Appl. No.: 09/855,947

(22) Filed: May 16, 2001

(65) Prior Publication Data

US 2002/0189975 A1 Dec. 19, 2002

(51) Int. Cl.[7] ..... C10G 45/00; C10G 17/02; C10G 24/00; C10G 25/00

(52) U.S. Cl. ..... 208/208 R; 208/219; 208/222; 208/244; 208/254 R; 208/255; 208/256; 208/295; 208/299

(58) Field of Search ..... 208/208 R, 219, 208/222, 244, 259 R, 255, 256, 295, 299

(56) References Cited

U.S. PATENT DOCUMENTS

| | | | | |
|---|---|---|---|---|
| 2,804,473 | A | 8/1957 | Phillips et al. | 260/502 |
| 3,847,800 | A | 11/1974 | Guth et al. | 208/236 |
| 4,311,680 | A | 1/1982 | Frech et al. | 423/230 |
| 5,755,977 | A | 5/1998 | Gurol et al. | 210/754 |
| 5,917,049 | A | 6/1999 | Suverkropp et al. | 546/320 |
| 6,126,838 | A | 10/2000 | Huang et al. | 210/712 |
| 6,140,294 | A | 10/2000 | Delroisse et al. | 510/304 |

FOREIGN PATENT DOCUMENTS

EP 0 565 324 A1 10/1993

OTHER PUBLICATIONS

Steven E. Bonde, et al., *Desulfurization by Selective Oxidation and Extraction of Sulfur–Containing in Diesel Fuel*, National Petrochemical & Refiners Association, AM–00–25, Mar. 26–28, 2000; pp. 2–13.

Cheves Walling; *Fenton's Reagent Revisited*, Accounts of Chemical Research, vol. 8, 1975, pp. 125–131.

Richard L. Valentine and H.C. Ann Wang, *Iron Oxide Surface Catalyzed Oxidation of Quiniline by Hydrogen Peroxide*, Journal of Environmental Engineering, Jan. 1998, pp. 31–38.

Takao Kaneko, et al., *Transformation of Iron Catalyst to the Active Phase in Coal Liquefaction*, Energy & Fuels, 1998, vol. 12, pp. 897–904.

Toshiaki Okui, et al., *Hydrocracking of Marlim Vacuum Residue Using Slurry Bed Reactor*, Proceedings of the International Symposium on Utilization of Super–Heavy Hydrocarbon Resources, Sep. 18–19, 2000, pp. 21–27.

*Primary Examiner*—Thuan D. Dang
(74) *Attorney, Agent, or Firm*—Sughrue Mion, PLLC

(57) ABSTRACT

A process for the catalytic oxidation of sulfur and nitrogen contaminants as well as unsaturated compounds present in a hydrocarbon fossil oil medium is described, the process comprising effecting the oxidation in the presence of at least one peroxide, at least one acid and a pulverized raw iron oxide. The process shows an improved oxidation power towards the contaminants typically present in a fossil oil medium, this deriving from the combination of the peroxy-acid and the hydroxyl radical generated in the reaction medium due to the presence of an iron oxyhydroxide such as a limonite clay, which bears a particular affinity for the oil medium. The process finds use in various applications, from a feedstock for refining until the preparation of deeply desulfurized and deeply denitrified products.

44 Claims, 5 Drawing Sheets

$$H_2O_2 \rightleftharpoons H^+ + OOH^-$$

$$^{\cdot}OOH^- \longrightarrow {}^{\bullet}OOH + e^-$$

$$^{\bullet}OOH \rightleftharpoons H^+ + {}^{\bullet}O_2^-$$

$$H_2O_2 + {}^{\bullet}OOH \longrightarrow {}^{\bullet}OH + H_2O + O_2$$

$$O_2^- \longrightarrow O_2 + e-$$

$$^{\bullet}OH + e^- \longrightarrow OH^-$$

$$Fe^{2+} + H_2O_2 \longrightarrow Fe^{3+} + OH^- + {}^{\bullet}OH$$

$$Fe^{3+} + H_2O_2 \longrightarrow Fe^{2+} + {}^{\bullet}OOH + H^+$$

$$H_2O_2 + {}^{\bullet}OOH \longrightarrow {}^{\bullet}OH + H_2O + O_2$$

$$Fe^{3+} + {}^{\bullet}OH \longrightarrow Fe^{2+} + OH^-$$

PROCESS FOR THE CATALYTIC OXIDATION OF SULFUR, NITROGEN AND UNSATURATED COMPOUNDS FROM HYDROCARBON STREAMS

FIELD OF THE INVENTION

The present invention relates to a process for the catalytic oxidation of sulfur, nitrogen and unsaturated compounds present in hydrocarbon streams of fossil oils, in the presence of a peracid and pulverized raw iron oxide, the process being carried out at atmospheric pressure and ambient or higher temperature supplied by self-heating. More specifically, the invention relates to a process for the simultaneous removal of sulfur, nitrogen and unsaturated compounds aided by the catalyst action of limonite clays that improve the oxidation potential of a peracid in oil phase, the peracid being either added as such or generated in situ by the combination of a peroxide and organic acid. The inventive process is specially suited to the removal of sulfur, nitrogen and unsaturated compounds from light, medium and heavy distillates obtained from petroleum, liquefied coal, shale oil and tar, with the preferred streams being heavy diesel oil or petroleum gasoils. The products from the oxidizing process are relatively lighter than the original oils, with sulfur compounds in the range of 0.010 weight % to 0.2 weight % and nitrogen compounds in the range of 0.0010 weight % to 0.15 weight %, according to process conditions. The inventive process encompasses still the removal of up to 50 weight % of olefins present in the feed.

BACKGROUND INFORMATION

The peroxide-aided oxidation is a promising path for the refining of fossil oils, and may be directed to several goals, for example to the removal of sulfur and nitrogen compounds present in fossil hydrocarbon streams, mainly those used as fuels for which the international specification as for the sulfur content becomes more and more stringent.

One further application is the withdrawal of said compounds from streams used in processes such as hydrotreatment, where the catalyst may be deactivated by the high contents in nitrogen compounds.

Basically, the peroxide oxidation converts the sulfur and nitrogen impurities into higher polarity compounds, those having a higher affinity for polar solvents relatively immiscible with the hydrocarbons contaminated by the sulfur and nitrogen compounds. This way, the treatment itself comprises an oxidation reaction step followed by a separation step of the oxidized products by polar solvent extraction and/or adsorption and/or distillation.

The oxidation reaction step using peroxides, as well as the separation steps of the oxidized compounds from the hydrocarbons have been the object of various researches.

Thus, EP 0565324A1 teaches a technique exclusively focused on the withdrawal of organic sulfur from petroleum, shale oil or coal with an oxidation reaction step with an oxidizing agent like $H_2O_2$ initially at 30° C. and then heated at 50° C. in the presence of an organic acid (for example HCOOH or AcOH) dispensing with catalysts, followed by (a) a solvent extraction step, such as N,N'-dimethylformamide, dimethylsulfoxide, N,N'-dimethylacetamide, N-methylpyrrolidone, acetonitrile, trialkylphosphates, methyl alcohol, nitromethane among others; or by (b) an adsorption step with alumina or silica gel, or (c) a distillation step where the improved separation yields are caused by the increase in boiling point of the sulfur oxidized compounds.

A similar treatment concept is used by D. Chapados et al in "Desulfurization by Selective Oxidation and Extraction of Sulfur-Containing Compounds to Economically Achieve Ultra-Low Proposed Diesel Fuel Sulfur Requirements", NPRA 2000 Annual Meeting, Mar. 26–28, 2000, San Antonio, Tex., Paper AM-00-25 directed to a refining process also focused on the reduction of the sulfur content in oils, the oxidation step occurring at temperatures below 100° C. and atmospheric pressures, followed by a polar solvent extraction step and by an adsorption step. The authors further suggest the use of a solvent recovery unit and another one for the biological treatment of the concentrate (extracted oxidized products) from the solvent recovery unit, this unit converting said extracted oxidized products into hydrocarbons.

According to the cited reference by Chapados et al., the reaction phase consists of an oxidation where a polarized —O—OH moiety of a peracid intermediate formed from the reaction of hydrogen peroxide and an organic acid performs an electrophilic oxidation of the sulfur compounds, basically sulfides such as benzothiophenes and dibenzothiophenes and their alkyl-related compounds so as to produce sulfoxides and sulfones.

U.S. Pat. No. 3,847,800 teaches that the oxidation of the nitrogen compounds, such as the quinolines and their alkyl-related compounds so as to produce N-oxides (or nitrones) can be promoted as well when reacting these compounds with a nitrogen oxide.

The mechanisms for the oxidation of sulfur containing compounds with a peracid derived from a peroxide/organic acid couple are shown in FIG. 1 attached, with dibenzothiophene taken as model compound.

According to U.S. Pat. No. 2,804,473, the oxidation of amines with an organic peracid leads to N-oxides, therefore a reaction pathway analogous to that of sulfur-containing compound is expected for the oxidation of nitrogen-containing compounds with a peracid derived from the peroxide/organic acid couple, as shown in FIG. 2 attached, with quinoline taken as model compound. In addition, the same U.S. patent teaches a process for the production of lower aliphatic peracids. According to this publication, peracids are useful in a variety of reactions, such as oxidation of unsaturated compounds to the corresponding alkylene oxide derivatives or epoxy compounds.

As illustrated in FIG. 3 attached, it is also well-known that hydrogen peroxide naturally decomposes into unstable intermediates that yield $O_2$ and $H_2O$, such process being accelerated by the action of light, heat and mainly by the pH of the medium.

U.S. Pat. No. 5,917,049 teaches a process for preparing dicarboxylic acids containing at least one nitrogen atom where the corresponding heterocyclic compound of fused benzene ring bearing at least one nitrogen atom is oxidized in the presence of hydrogen peroxide, a Bronsted acid and an iron compound. The preferred iron compound is iron nitrate and nitric acid is used as the Bronsted acid. The reaction occurs in an aqueous medium.

Besides, U.S. Pat. No. 4,311,680 teaches a process for removal of sulfur containing compounds such as $H_2S$, mercaptans and disulfides from gas streams exclusively such as natural gas by flowing the said gas stream through a $Fe_2O_3$ fixed bed in presence of an aqueous solution of hydrogen peroxide.

On the other hand, several publications report the use of the Fenton's reagent exclusively directed for the withdrawal of pollutants from aqueous municipal and industrial effluents. See the article by C. Walling, "Fenton's Reagent Revisited", Accts. Chem. Res., Vol. 8, p. 125–131 (1975), U.S. Pat. No. 6,126,838 and U.S. Pat. No. 6,140,294 among others.

Fenton's reagent, known since 1894, is traditionally a mixture of $H_2O_2$ and ferrous ions exclusively in an aqueous medium, so as to generate the hydroxyl radical OH. as illustrated in FIG. 4 attached. The hydroxyl radical is one of the most reactive species known. Its Relative Oxidation Power (ROP) ROP=2.06 (relative to $Cl_2$ whose ROP=1.0), is higher than that for example of singlet oxygen (ROP=1.78)>$H_2O_2$ (ROP=1.31)>HOO. (ROP=1.25) >permanganate (ROP=1.24), this making it able to react with countless compounds.

However, side reactions consume or compete with the hydroxyl radical due to the presence of $Fe^{3+}$ or due to the natural dissociation of the hydrogen peroxide, as illustrated in FIG. 5 attached.

Such side reactions may be minimized by reducing the pH in the medium, since the protic acidity reverts the dissociation equilibrium of the $H_2O_2$ into $H^+$ and $OOH^-$ (as per FIG. 3 attached), so as to prevent the transformation of the generated OOH— into HOO. which will lead more $H_2O_2$ to $H_2O$ and $O_2$ in spite of the co-generation of the desired hydroxyl radical. On the other hand, excessive lowering of pH leads to the precipitation of $Fe(OH)_3$ that catalyses the decomposition of $H_2O_2$ to $O_2$.

Thus, it is recommended to work at pH 2.0–6.0, while afterwards adjusting the reaction pH until 6.1–9.0 to allow for a better separation of the products by flocculation of the residual ferrous sulfate salts, when this salt is the source of ferrous cations of the conventional Fenton's reagent.

However, in case of any free ferric cations are produced and consume or inhibit the generation of the hydroxyl radical (as per FIG. 5), those could be scavenged by complexing agents (as for example phosphates, carbonates, EDTA, formaldehyde, citric acid) only if those agents would not at the same time scavenge the ferrous cations also solved in aqueous media and required for the oxidation reaction.

Sources of active Fe attached to a solid matrix known as useful for generating hydroxyl radicals are the crystals of iron oxyhydrates FeOOH such as Goethite, used for the oxidation of hexachlorobenzene found as a pollutant of soil water resources.

R. L. Valentine and H. C. A. Wang, in "iron oxide Surface Catalyzed Oxidation of Quinoline by Hydrogen Peroxide", Journal of Environmental Engineering, 124(1), 31–38 (1998), relate a procedure to be used exclusively on aqueous effluents using aqueous suspensions of ferrous oxides such as ferrihydrite, a semicrystalline iron oxide and goethite, both being previously synthesized, to catalyze the hydrogen peroxide oxidation of a model water polluting agent, quinoline, present in concentrations of nearly 10 mg/liter in an aqueous solution the characteristics of which mime a natural water environment. Among the iron oxides used by the authors, a suspension of crystalline goethite containing a complexing agent (for example carbonates) produced higher quinoline abatement from the aqueous solution, after 41 hours reaction. According to the author, the complexing agent is adsorbed on the catalyst surface so as to regulate the decomposition of $H_2O_2$. The article does not mention the formed products and the Goethite employed was a pure crystalline material synthesized by aging $Fe(OH)_3$ at 70° C. and pH=12 during 60 h.

Pure goethite such as the one utilized by Valentine et al. is hardly found in free occurrences in the nature; however, it can exist as a component of certain natural ores.

U.S. Pat. No. 5,755,977 teaches a process where a contaminated fluid such as water or a gas stream containing at least one contaminant is contacted in a continuous process with a particulate goethite catalyst in a reactor in the presence of hydrogen peroxide or ozone or both to decompose the organic contaminants. It is mentioned that the particulate goethite may also be used as a natural ore form. However, the particulate goethite material actually used by the author in the Examples was a purified form purchased from commercial sources, and not the raw natural ore.

Goethite is found in nature in the so-called limonite and/or saprolite mineral clays, occurring in laterites (natural occurrences which were subjected to non-eroded weathering, i.e. by rain), such as in lateritic nickel deposits, especially those layers close by the ones enriched in nickel ores (from 5 to 10 m from the surface). Such clays constitute the so-called limonite zone (or simply limonite), where the strong natural dissolution of Si and Mg leads to high Al, Ni concentrations (0.8–1.5 weight %), also Cr and mainly Fe (40–60 weight %) as the hydrated form of FeOOH, that is, $FeOOH._nH_2O$.

The layers below the limonite zone show larger amounts of lateritic nickel and lower amounts of iron as Goethite crystals. This is the so-called saprolite zone or serpentine transition zone (25–40 weight % Fe and 1.5–1.8 weight % Ni), immediately followed by the garnierite zone (10–25 weight % Fe and 1.8–3.5 weight % Ni) that is the main source of garnierite, a raw nickel ore for industrial use.

The open literature further teaches that the crystalline iron oxyhydroxide FeOOH may assume several crystallization patterns that may be obtained as pure crystals by synthetic processes. Such patterns are: α-FeOOH (Goethite cited above), γ-FeOOH (Lepidocrocite), β-FeOOH (Akaganeite), or still δ'-FeOOH (Ferroxyhite), this latter having also magnetic properties. The most common crystallization patterns are Goethite and Lepidocrocite.

The iron oxyhydroxide crystalline form predominant in limonite is α-FeOOH, known as Goethite. The Goethite (α-FeOOH) crystallizes in non-connected layers, those being made up of a set of double polymeric ordered chains. This is different, for example, from the synthetic form Lepidocrocite (γ-FeOOH), which shows the same double ordered chain set with interconnected chains. This structural difference renders the α-FeOOH more prone to cause migration of free species among the non-connected layers.

Limonite contains iron at 40–60 weight % besides lower contents of nickel, chrome, cobalt, calcium magnesium, aluminum and silicon oxides, depending on the site of occurrence.

The specific area of limonite is 40–50 $m^2/g$, besides being a low cost mineral, of easy pulverization and handling; its dispersion characteristics in hydrophobic mixtures of fossil hydrocarbons are excellent.

Limonite was found to be easily dispersed in fossil oils as a precursor of pyrrothite ($Fe_{1-x}S$), as reported by T. Kaneko et al in "Transformation of Iron Catalyst to the Active Phase in Coal Liquefaction", Energy and Fuels 1998, 12, 897–904 and T. Okui et al, in "Proceedings of the Intl. Symposium on the Utilization of Super-Heavy Hydrocarbon Resources (AIST-NEDO)", Tokyo, September 2000.

This behavior is different from that of a Fe(II) salt such as ferrous sulfate or ferrous nitrate, that requires an aqueous medium to effect the formation of Fenton's reagent.

Thus, the present invention makes use of the oil dispersion character of pulverized limonite ore in order to perform the direct Fenton-type oxidation of sulfur and nitrogen contaminants present in an oil phase, in addition to the classical oxidation worked by peroxides alone.

Thus, the literature mentions processes for the treatment of organic compounds from fossil oils through oxidation in the presence of peracids (or peroxides and organic acids) exclusively. On the other hand, there are also treating processes of aqueous or gaseous media using the Fenton's reagent. However, there is no description nor suggestion in the literature of a process directed to the catalytic oxidation of organic compounds in a hydrophobic, fossil oil medium in the presence of a peracid (or peroxide/acid couple), the oxidation reaction being catalyzed by an iron oxide such as a pulverized limonite ore working as a highly-dispersible source of catalytically active iron in this oil medium, said process being described and claimed in the present application.

SUMMARY OF THE INVENTION

Broadly, the present invention relates to a process for the catalytic oxidation of sulfur, nitrogen and unsaturated compounds present in high amounts in fossil oils, said oxidation being effected in the presence of peroxide/organic acids and a catalyst from a raw iron oxide such as the limonite clays, used in the natural state.

The invention is also directed to the simultaneous removal of the sulfur, nitrogen and unsaturated compounds from said fossil oils by catalytic oxidation.

The process leads either to a feedstock for refining or to a deeply desulfurized and denitrified end product.

The process for the catalytic oxidation of sulfur, nitrogen and unsaturated compounds from hydrocarbon streams contaminated with said compounds comprises the following steps:

a) Providing a pulverized raw iron oxide;

b) Providing at least one acid;

c) Providing at least one peroxide;

d) Oxidizing unsaturated compounds as well as sulfur and nitrogen contaminants by admixing, under atmospheric pressure and equal or higher than ambient temperature, under agitation, said organic acid and said hydrocarbon stream contaminated with sulfur, nitrogen and unsaturated compounds and then said peroxide, so as to obtain a peracid, the molar amount of peroxide and organic acid relative to the sum of the nitrogen and sulfur contents present in the hydrocarbon stream being at least 3.0, at pH between 2.0 and 6.0, for the required period to obtain a hydrocarbon stream where the unsaturated, sulfur and nitrogen contaminants have been partially oxidized;

e) Further oxidizing said unsaturated compounds as well as sulfur and nitrogen contaminants in the presence of oxidant hydroxyl radicals generated by adding to said partially oxidized hydrocarbon stream, under atmospheric pressure and equal or higher than ambient temperature, the higher than ambient temperature being generated by the process itself, under agitation, a catalytic amount of said pulverized raw iron oxide so as to obtain a slurry of iron oxide, hydrocarbon stream and oxidized unsaturated, sulfur and nitrogen compounds, the reaction conditions being kept during 1–2 hours and an acidic pH between 2.0 and 6.0;

f) After the end of the reaction, filtrating the reaction medium containing an aqueous phase and an oily hydrocarbon phase, and separating the spent iron oxide catalyst;

g) Decanting in order to separate the organic-rich aqueous phase;

h) Correcting the pH of the resulting oily hydrocarbon phase to values between 6.1 and 9.0 and recovering the oil phase;

i) Post-treating the oil phase to extract the oxidized products at the desired level; and j) Recovering the post-treated hydrocarbon phase having sulfur compounds in the range of 0.01 weight % and 0.2 weight % and nitrogen compounds in the range of 0.001 weight % to 0.15 weight %, the final olefin content being up to 50% of the original olefin content.

Alternatively, the pulverized raw iron oxide is added in the first place to the hydrocarbon stream contaminated with sulfur, nitrogen and unsaturated compounds.

Still another alternative is the use of an oxidation aid in an amount between 0.1 and 10% by volume based on the total volume, of mineral acid such as phosphoric acid before the addition of organic acid and peroxide.

Thus the present invention provides a process for the catalytic oxidation of sulfur, nitrogen and unsaturated compounds from fossil oils contaminated with said compounds through oxidation with peroxides and organic acids, the oxidation being aided by a source of active fixed iron generated in situ from a raw iron ore such as limonite.

The present invention provides also a process for the simultaneous removal of sulfur, nitrogen and unsaturated compounds from fossil oils contaminated with said compounds through oxidation with peroxides and organic acids, the oxidation being aided by a source of active fixed iron generated in situ from a pulverized raw iron oxide ore such as limonite.

The present invention provides still a process for the catalytic oxidation of sulfur, nitrogen and unsaturated compounds from fossil oils contaminated with said compounds at atmospheric pressure and equal or higher than ambient temperature, such process being a source of energy that may be used in the same or any other industrial process.

The present invention provides further a process for the catalytic oxidation of sulfur, nitrogen and unsaturated compounds from fossil oils contaminated with said compounds where the improved oxidation in the presence of limonite catalyst yields oxidized compounds that are more soluble in certain solvents than the oxidized compounds produced in the absence of limonite.

The present invention provides further a process for the catalytic oxidation of sulfur, nitrogen and unsaturated compounds from fossil oils contaminated with said compounds where the dispersion character of the pulverized limonite catalyst in the oil medium is responsible for the improved oxidation of oil containing sulfur, nitrogen and unsaturated contaminants.

The present invention provides still a catalytic oxidation process for obtaining hydrocarbon streams from fossil oils contaminated with said compounds having sulfur contents lower than 0.2 weight %, these streams being useful as feedstock for further refining processes such as hydrotreatment or catalytic cracking.

The present invention provides further a catalytic oxidation process for obtaining, from hydrocarbon streams contaminated with 2.0 weight % of total N and 2 weight % total S, deeply desulfurized and deeply denitrified hydrocarbon streams having sulfur contents less than 0.015 weight % and nitrogen contents less than 0.001 weight %.

The present invention provides further a catalytic oxidation process for obtaining, from hydrocarbon streams having up to 40 weight % olefins, the removal of nearly 50 weight % of the original olefins.

DETAILED DESCRIPTION OF THE PREFERRED MODES

Figure 1:
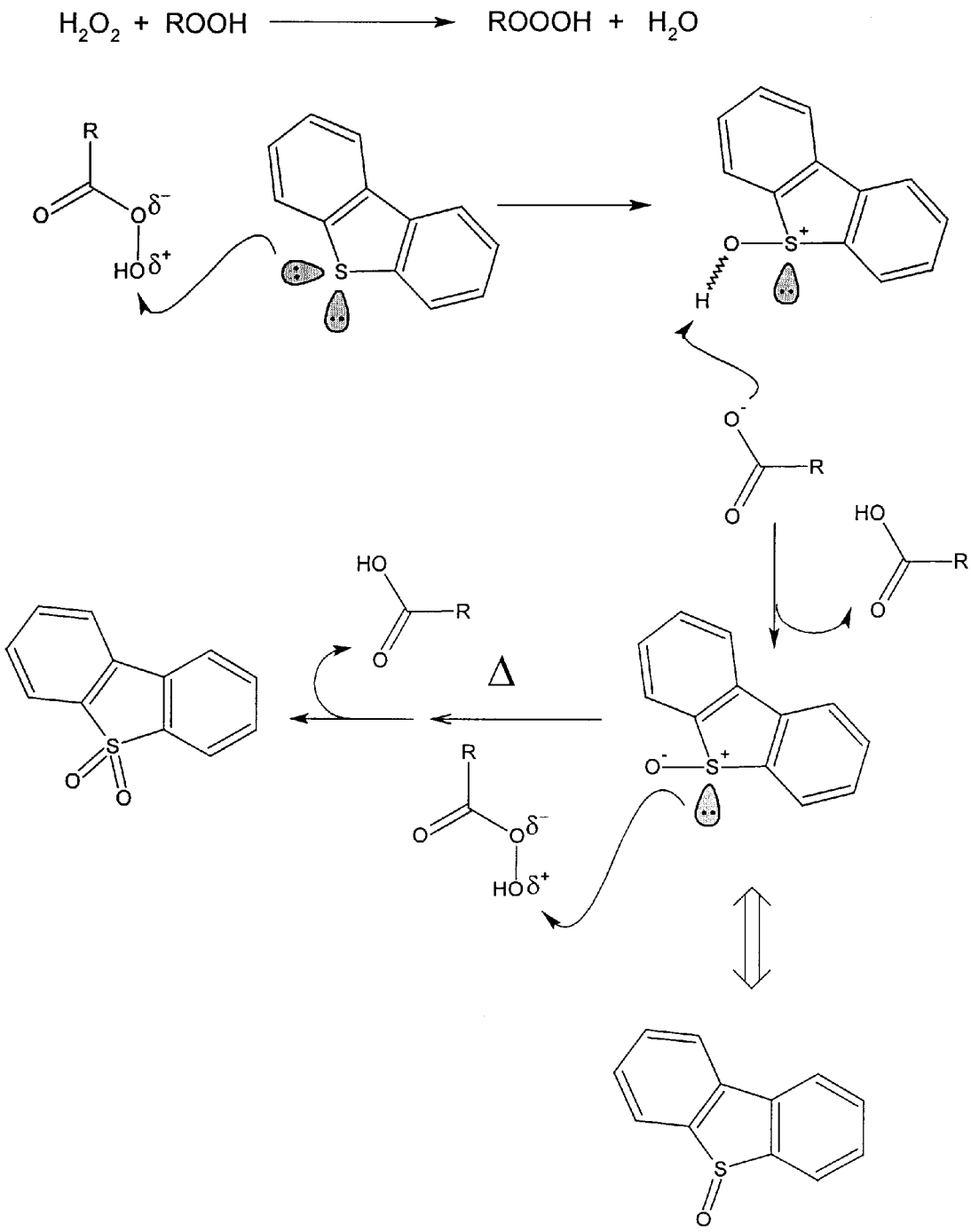
FIG. 1 attached illustrates the oxidation mechanism of a model sulfur compound such as dibenzothiophene that generates sulfoxides and sulfones, in the presence of hydrogen peroxide and an organic acid.
Figures 2, 3:
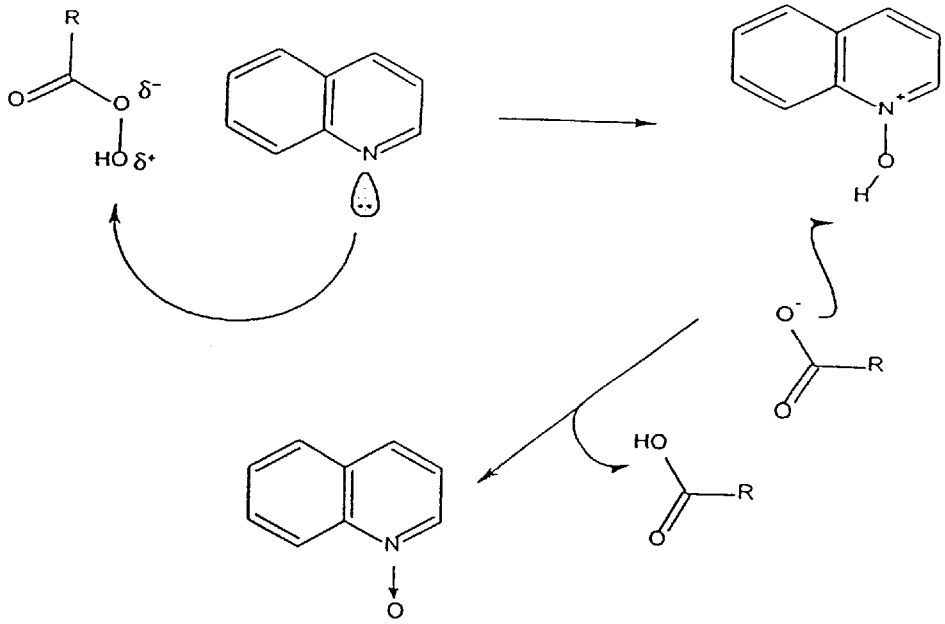
FIG. 2 attached illustrates the oxidation mechanism of a model nitrogen compound such as quinoline so as to generate the equivalent N-oxide and regenerating the organic acid.
FIG. 3 attached illustrates the natural decomposition mechanism of the hydrogen peroxide.

As stated hereinbefore, the present process for the catalytic oxidation of sulfur, nitrogen and unsaturated compounds from fossil hydrocarbon streams contaminated with these compounds occurs through the oxidation of same in the presence of peroxides, at least one acid and a pulverized raw iron oxide ore.

The so performed catalytic oxidation allows the simultaneous removal of the sulfur, nitrogen and unsaturated compounds from the contaminated fossil hydrocarbon streams.

The hydrocarbon streams to be oxidized by means of the present oxidation and simultaneous removal of sulfur, nitrogen and unsaturated compounds comprehend a raw petroleum oil or its heavy fractions, alone or admixed in any amount, fuels, lubricants, raw or fractionated shale oil and its fractions alone or admixed in any amounts, liquid coal oil and related products, or oil sands and related products.

The preferred hydrocarbon streams to be treated by the process of the invention are those having End Boiling Point (EBP) until ca. 500° C., that is, gasoil streams and medium distillates, such as heavy diesel oil or light diesel oil, alone or admixed in any amounts.

Typically, the streams to be treated by the present process contain until 2.0 weight % total S and until 2.0 weight % total N for petroleum-derived streams and shale oil and related-derived streams.

Also, the streams contain up to 40 weight % of unsaturated compounds, more specifically open-chain or cyclic olefin compounds, for example, monoolefins, diolefins or polyolefins.

The catalyst oxidation process herein presented occurs by the combination of peroxide and at least one acid, the oxidation being activated by a pulverized raw Fe oxide.

Crystalline, semi-crystalline and amorphous forms of iron oxide compounds may be used. Useful iron oxides are those iron oxyhydroxides mentioned hereinbefore, such as α-FeOOH (Goethite), γ-FeOOH (Lepidocrocite), β-FeOOH (Akaganeite), or still δ'-FeOOH (Ferroxyhite), this latter having also magnetic properties. A preferred form of iron oxyhydroxide is a limonite clay.

Limonite clays are abundant in numerous natural occurrences around the world, for instance, Brazil, Australia, Indonesia, Venezuela and other countries. In some cases limonite is a waste product from nickel mining activities and therefore a low-cost material.

For the purposes of the invention, the limonite clay is used in the natural state, only pulverized until a granulometry lower than 0.71 mm (25 mesh Tyler), preferably lower than 0.25 mm (60 mesh Tyler).

It is obvious for the experts that a limonite ore of granulometric range where the size of the grains is smaller than 0.04 mm (325 mesh Tyler) or less may be used, this allowing high dispersion degrees and therefore causing larger contact surface of the solid limonite with the oil phase, which ultimately produces increased strength of the oxidation reaction.

The limonite surface area is 40–50 $m^2/g$. The iron content of limonite is around 40–60 weight %.

It should be understood that pulverized limonite has a strong affinity for the oil phase; it is wetted by the oil and interacts with peroxides (hydrogen peroxide and peroxyacids) which are usually present in an aqueous phase. Therefore, without willing to be specially bound to any particular theory, it is hypothesized that the goethite surface present in pulverized limonite carries those peroxides to the oil phase. At the same time those peroxides cause fixed Fe sites to be activated from Fe (III) to Fe (II), which catalyzes the formation of the hydroxyl radical.

The catalytic amount of limonite to be used in the present process may vary within rather large limits, for example of from 0.01 to 5.0 weight %, and more preferably of from 1.0 to 3.0 weight % based on the weight of hydrocarbon oil submitted to the process.

The iron catalyst may be prepared by pulverizing, kneading, granulating and calcining the above cited oxides, the iron being in the form of hydroxide, oxide or carbonate, alone or admixed with inorganic materials such as alumina, silica, magnesia, calcium hydroxide, manganese oxide and the like.

Alternatively, the oxidation of organic substances of fossil oils at room temperature may be also effected in colloidal phase, especially in the case of fossil oil media more viscous than for example petroleum gasoils.

The peroxide useful in the practice of the invention may be inorganic or organic.

Analogously to the peroxide, ozone may be used as well, alone or in admixture with the peroxide(s).

Preferably the inorganic peroxide is a hydroperoxide that may be the hydrogen peroxide $H_2O_2$.

Hydrogen peroxide is preferably employed as an aqueous solution of from 10% to 90% by weight $H_2O_2$ based on the weight of the aqueous hydrogen peroxide solution, more preferably containing of from 25% to 6.0% by weight $H_2O_2$.

The organic peroxide can be an acyl hydroperoxide of formula ROOH, where R=alkyl, $H_{n+2}C_nC(=O)$—(n>=1), Aryl-C (=O)—, HC(=O)—.

The organic acid is preferably a carboxylic acid RCOOH or its dehydrated anhydride form RC(=O)OC(=O)R, where R can be H, or $C_nH_{n+2}$(n>=1) or $X_mCH_{3-m}COOH$ (m=1~3, X=F, Cl, Br), polycarboxylic acid —[R(COOH)—R(COOH)]$_{x-1}$— where (x>=2), or still a benzoic acid, or mixtures of same in any amount.

The inorganic acid may be any strong inorganic acid, that is to be used diluted, such as for example carbonic acid, phosphoric acid solutions or an equivalent buffer of pH between 2.0 and 6.0.

In the present invention, in case the oxidation is directed to heteroatom organic compounds, the molar ratios of peroxide/heteroatoms and organic acid/heteroatoms are both equal or larger than 2.0. Thus is secured an oxidation that allows further easy removal of such heteroatom compounds.

As for pressure and temperature parameters of the present process, the pressure is the atmospheric pressure. The temperature of the process is between 20° C. and 100° C., the higher-than ambient temperatures being caused exclusively by the exothermic character of the process, under no circumstance being due to any external heating.

The period of time for the reaction to occur is between 1 and 2 hours; however, post-reaction contact times of several hours or days between raw iron oxide spent catalyst and oxidized products favor the adsorption of said compounds by the spent catalyst.

The energy released by the process may be directed to an area of the industrial unit that can take advantage of the thermal energy in any unit operation.

In view of the presence of acids in the reaction medium the pH of the medium is generally acid, varying from 2.0 to 6.0, preferably 3.0.

As for the order of addition of the oxidizing compounds contemplated in the practice of the invention to the oxidizing and removal of S- and N-compounds of a fossil oil medium such as a hydrocarbon stream, the concept of the invention contemplates two main modes.

Thus, according to one preferred mode of the invention, the iron oxide is added to the fossil oil medium, left under agitation for a certain period of time and then are added the peroxide and the acid. The overall mixture is kept under agitation for 1–2 hours. Under the action of the acid, the pH of the reaction mixture is kept between 2.0 and 6.0. Heat is released.

According to another preferred mode of the invention, organic acid is first added to the fossil oil medium being kept under agitation during a few minutes, followed by the addition of iron oxide and peroxide. The final mixture is kept under agitation during 1–2 hours at ambient temperature.

One variation of this mode is the initial addition of a mineral acid to the fossil oil medium, followed by the iron oxide, organic acid and peroxide. The reaction conditions comprise agitation of the reaction medium for the period of time required for the oxidation reaction and an acidic pH between 2.0 and 6.0.

Still another mode is the initial addition of peroxide to the fossil oil medium, followed by acid alone or in admixture and iron oxide.

A further mode comprises the simultaneous addition of iron oxide, peroxide and acid to the oil medium, under the reaction conditions of agitation, acidic pH between 2.0 and 6.0 and period of time for oxidation.

After the oxidation the medium is neutralized at a pH 6.1–9.0 with the aid of saturated NaOH solution or a sodium sulfite solution.

The iron component, as found throughout the surface of the particles of finely pulverized limonite is adequate for the reaction with a peroxide (for example $H_2O_2$) in contact with an oil phase in order to generate the hydroxyl radical, active to oxidize organic compounds such as unsaturated compounds as well as nitrogen and sulfur contaminants present in said oil phase.

The generated hydroxyl radical is a powerful oxidant and its oxidative activity is associated to the ionic oxidative activity of the organic peracid, substantially improving the oxidation of fossil oils and related products. As will be shown later in the present specification by means of a comparative Example, the produced oxidized compounds show stronger affinity for polar solvents than in the case the oils were treated with the peroxide-organic acid couple alone.

Thus the process of the invention involves fundamentally an oxidation step at ambient temperature that combines in a synergistic way two reaction mechanisms: (1) one via active free radicals, produced by the reaction of at least one peroxide with the surface of the crystals of the iron oxide combined to (2) an oxidation via the action of a peracid intermediate generated from the reaction of the peroxide with an organic acid.

As will be seen later in the present specification, researches conducted by the Applicant have led to the conclusion that such two combined oxidation mechanisms yield an end product of low contents in total sulfur, nitrogen and unsaturated compounds comprising lighter products resulting from oxidation reactions.

Also, not only the number of so-generated sulfur and nitrogen oxidized compounds is larger than the number of oxidized compounds generated in state-of-the-art processes based on peracid alone, but also the present process makes possible to oxidize unsaturated hydrocarbon moieties, be those moieties straight-chain, cyclic, heteroatomic or not, this rendering easier the removal of reaction products either by solvent extraction or adsorption.

Unexpectedly, as a result of the inventive combination of peroxide/organic acid/limonite the extent of removal of sulfur compounds, relative to the extent of removal of nitrogen compounds is strongly dependent on the amount of components of the peroxide/organic acid/limonite trio, that is, larger molar ratios of peroxide and organic acid leads to more pronounced removal of sulfur compounds relative to the removal of nitrogen compounds. In addition, the larger molar peroxide ratio favors the removal of unsaturated compounds to some extent. Thus the present invention relates to a flexible process, easily adaptable to the contaminating conditions of the hydrocarbon feedstock to be treated.

The flexibility of the process leads to important developments. Thus, depending on the extent to which the oxidation/post-reaction procedures are carried out, two distinct end products may be obtained:

1. thorough oxidation as well as thorough post-reaction procedures lead to a deeply desulfurized and deeply denitrified end product that is a middle distillate having contents in sulfur, nitrogen and unsaturated compounds at levels according to stringent environmental regulations. The S content of such product is lower than 0.015 weight % (150 ppm), the N content is lower than 0.001 weight % (10 ppm). Olefin content is up to 50 weight % less than that of the original oil. Mass balance yields reach at least 50 weight % based on the original oil;
2. milder oxidation as well as milder post-reaction procedures lead to products having contents in sulfur, nitrogen and unsaturated compounds at levels that allow it to be directed to refining processes such as hydrotreatment or other processes. The N content of such products is lower than 0.1 weight % (1000 ppm). Mass balance yields in end products reach 80–90 weight % based on the original oil.

It should be understood that these two product categories are interlinked so that many intermediate product grades may be obtained by varying the number of post-oxidation procedures (extraction/adsorption) as well as the amount of the treating agent used. Thus, for example, a post-oxidized oil may be prepared for further refining processes by submitting it to brine extraction alone or be followed by successive extractions with varying amounts of brine alone or ethyl alcohol alone or still followed by DMF extraction, the ultimate finishing being an adsorption step leading to an end product such as middle distillate ready for use without any further treatment.

Another important feature of this flexible post-oxidation procedures is that the more extractions are effected, the higher the product quality, and the lower the yield in end product. On the other hand, less post-oxidation procedures lead to higher yields of a somehow lower quality product.

The separation of the post-oxidized sulfur and nitrogen compounds is easily made. Thus, such compounds can be extracted by deposition on the spent catalyst.

Alternatively, the oxidized products can be extracted with at least one polar organic solvent, said extract being rich in oxidized compounds, be them heteroatomic or not. These compounds may be concentrated by evaporation of the solvent, which is then reused.

Alternatively, the treated slurry of catalyst, oxidized compounds and fossil oil is washed with an aqueous salt solution, yielding a residue rich in oxidized compounds.

Alternatively, according to the principles of the invention, the hydrocarbon stream to be treated may be previously emulsified in a surfactant solution by vigorous agitation during 30 seconds in a colloidal mill so as to produce a temporary colloid, that is, coalescent after ca. 2 hours, this being the period of time required for the oxidation reaction. This procedure obviously secures an oil/water larger contact surface only during the reaction period. The surfactant content in the emulsified aqueous solution may vary between 1.5 weight % to 2.5 weight % depending on the features of the hydrocarbon stream to be treated.

Useful surfactants are mainly non-ionic surfactants such as any ethoxylated fatty alcohol such as ethoxylated lauryl alcohol, ethoxylated alkylphenol (for example ethoxylated nonyl phenol, ethoxylated octyl phenol), N-alkyl glycoseamide, fatty alcohol amides, fatty oxide amines.

The yields obtained in the removal of sulfur and nitrogen compounds are increased with the aid of the said surfactants. However, a drawback is that the post-oxidation steps may become more difficult to implement due to difficulties in the filtration and separation steps of the aqueous phase from the treated oil, this being true especially in case of more viscous oils. One way of avoiding the problems caused by the use of surfactants is to adjust the pH to 8.0–9.0, this improving the separation of the phases from the filtrated reaction product.

The oxidized products may be extracted for example with a polar organic solvent, that may be re-used after regeneration by fractioning. The solvent may be N,N'-dimethylformamide, N,N'-dimethylsulfoxide, N,N'-dimethylacetamide, N-methylpyrrolidone, acetonitrile, trialkylphosphates, nitromethane, ethyl alcohol, methyl alcohol, furfural, alone or admixed in any amounts.

Alternatively, the oxidized products are extracted by adsorption, alumina or silica gel being the preferred adsorbents. The adsorption step may be used either exclusively or as a finishing treatment after the extraction step.

It is obvious for the experts that any combination of the post-oxidation purification techniques may be used to separate the oxidized products resulting from the inventive process.

Typically, according to the preferred procedure adopted in the invention, the separation of the oxidized products is effected in two steps:

The first step yields an intermediate oil separated by filtration and decanting, that after extraction with brine and washing with distilled water yields an intermediate oil of low sulfur removal, typically between 2% and 15 weight % of removal.

In the second step the intermediate oil is dried and washed with an aprotic polar solvent such as N,N'-dimethylformamide (DMF) analytical grade, under agitation and then with acidic brine for removal of residual DMF. The DMF-rich extract, washed 2 times with a neutral NaCl (10 weight %) solution, has $N_{total}$=800 ppm and $N_{basic}$=160 ppm ($N_{total}/N_{basic}$=5) while the original oil shows $N_{total}/N_{basic}$= 1.1, indicating that the extracted nitrogen compounds are mostly non basic nitrogen compounds that lost the basic character due to oxidation.

Figures 4, 5, 6:
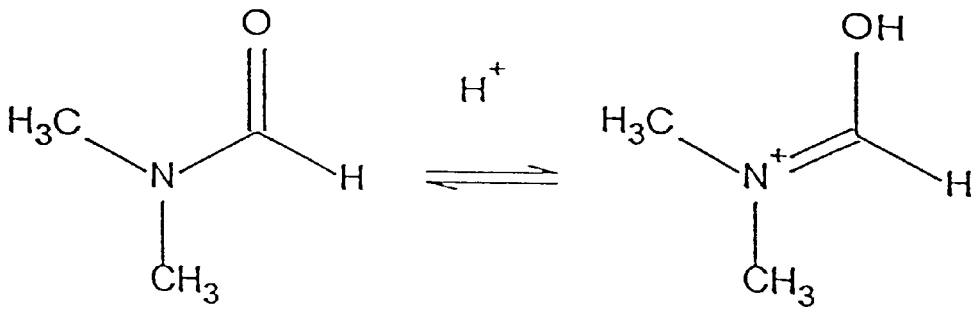
FIG. 4 attached illustrates the composition of Fenton's reagent, a mixture of $H_2O_2$ and ferrous ions so as to generate the hydroxyl radical.
FIG. 5 attached illustrates the mechanism of side reactions that consume or compete with the formation of the hydroxyl radical.
FIG. 6 attached illustrates the tautomeric behavior of N,N'-dimethylformamide.

The extraction of heteroatom compounds from oils using aprotic polar solvents such as N,N'-dimethylformamide (DMF) is a known procedure. However, it was found that water washing (as used in EP 0565324) does not prevent residual DMF in oil, this masking the nitrogen content assessment. That is why in the present application water was replaced by a 10 weight % NaCl brine, this latter improving the DMF removal. However, DMF traces are left in the original oil. Thus an acidic brine was used in order to take advantage of the tautomeric behavior of N,N'-dimethylformamide. The acidic brine is prepared by adding $KH_2PO_3$, that provides the aqueous medium with free protons that interact with the enol form of DMF, displacing the tautomeric balance and thus increasing the driving force for removal of DMF from the oil phase. This behavior is illustrated in FIG. 6 attached.

The hydroxyl radical generated is a powerful oxidant, and its oxidative action is associated to the oxidative action of the organic peracid (generated by the reaction of organic acid and peroxide or added as such) so that the oxidation of organic compounds of fossil oils is improved, the oxidized compounds so produced having more affinity for polar solvents than they would if they were treated in the presence of the peroxide-organic acid couple alone.

The inventive process promotes the oxidation via the hydroxyl radical combined to the oxidation via peracid, yielding a mixture of compounds having hydroxyl groups and heteroatom-containing compounds such as nitrones (or N-oxides) sulfoxides and sulfones along with non-oxidized heteroatom compounds, as illustrated by infrared Fourier transform analyses of the product solubilized in N,N'-dimethylformamide and of the organic matter decanted on the spent catalyst. The infra-red analyses were run using a FT-IR Nicolet Magna 750 Spectrophotometer.

Figure 7:
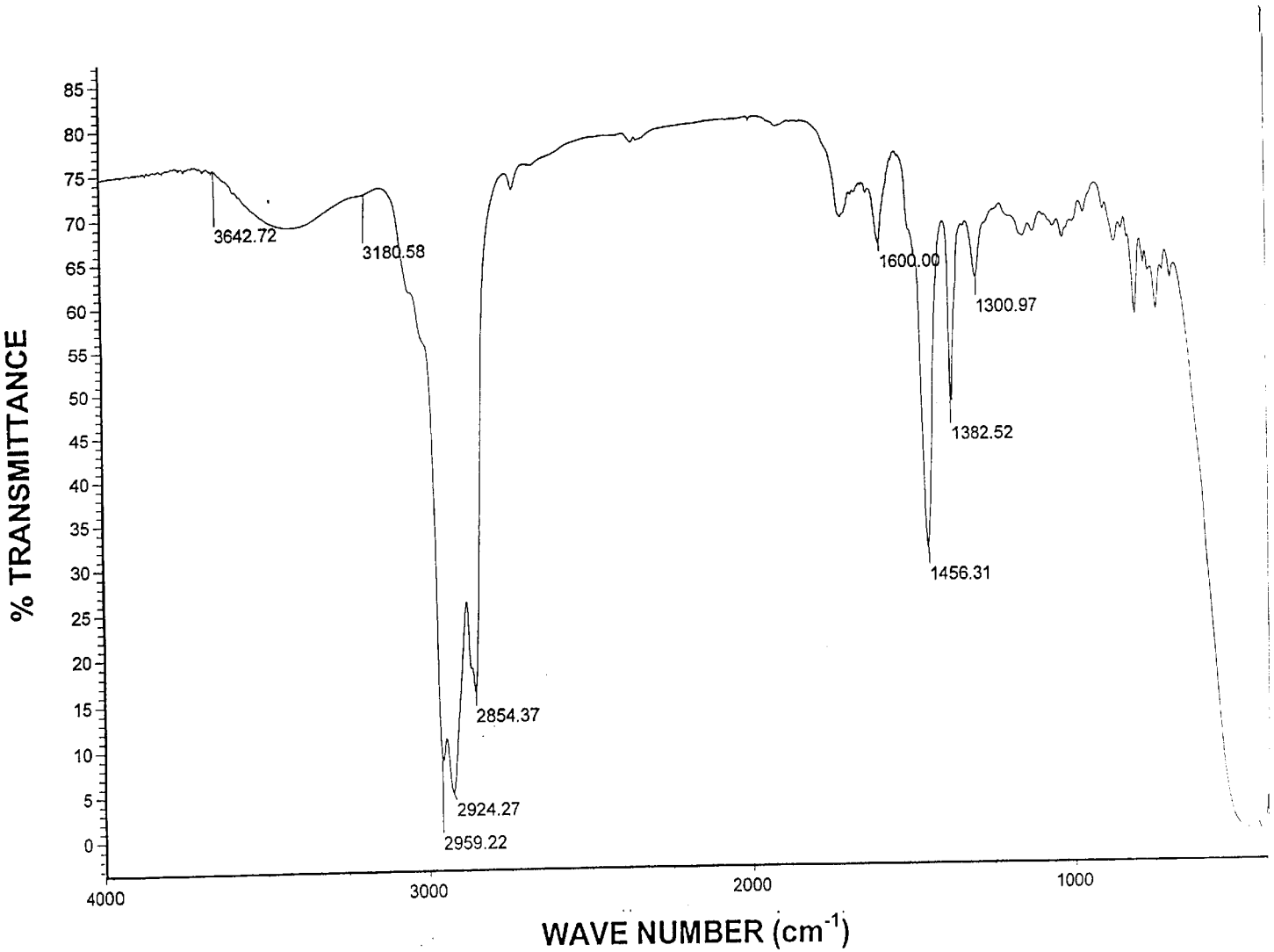
FIG. 7 attached is an FT-IR spectrum of a DMF-soluble post-oxidized material resulting from the oxidation reaction of organic compounds present in a stream of fossil hydrocarbons according to the invention.

The FT-IR spectrum of a sample of the extract obtained by extracting the product of the oxidation reaction of a gasoil with N,N'-dimethylformamide, removing the solvent by washing with a phosphate buffer solution. (pH=4) and dried over anhydrous $MgSO_4$ is illustrated in FIG. 7. Thus, a) A broad 3200–3600 $cm^{-1}$ band typical of the O—H bond stretching vibration of alcohols and/or phenols;

b) Large and intense bands at ~2854 $cm^{-1}$, ~2924 $cm^{-1}$ and ~2959 $cm^{-1}$ typical of —C—H stretching of alkyl, aromatic and other unsaturated hydrocarbons.

c) Bands at ~1382 $cm^{-1}$, ~1456 $cm^{-1}$; ~1600 $cm^{-1}$ and around 1300~1312 $cm^{-1}$ indicating the presence of nitrones, sulfoxides and sulfones along with the presence of original non-oxidized compounds such as disulfides, those latter specially due to the presence of bands around ~1456 $cm^{-1}$; ~1600 $cm^{-1}$.

After the reaction is completed, the spent catalyst of the invention is normally water washed, n-pentane washed and then dried in an oven under reduced pressure at 70° C. for several hours, resulting in a solid material having an excess weight of organic mater equivalent to ~0.2% of the oil medium.

Figure 8:
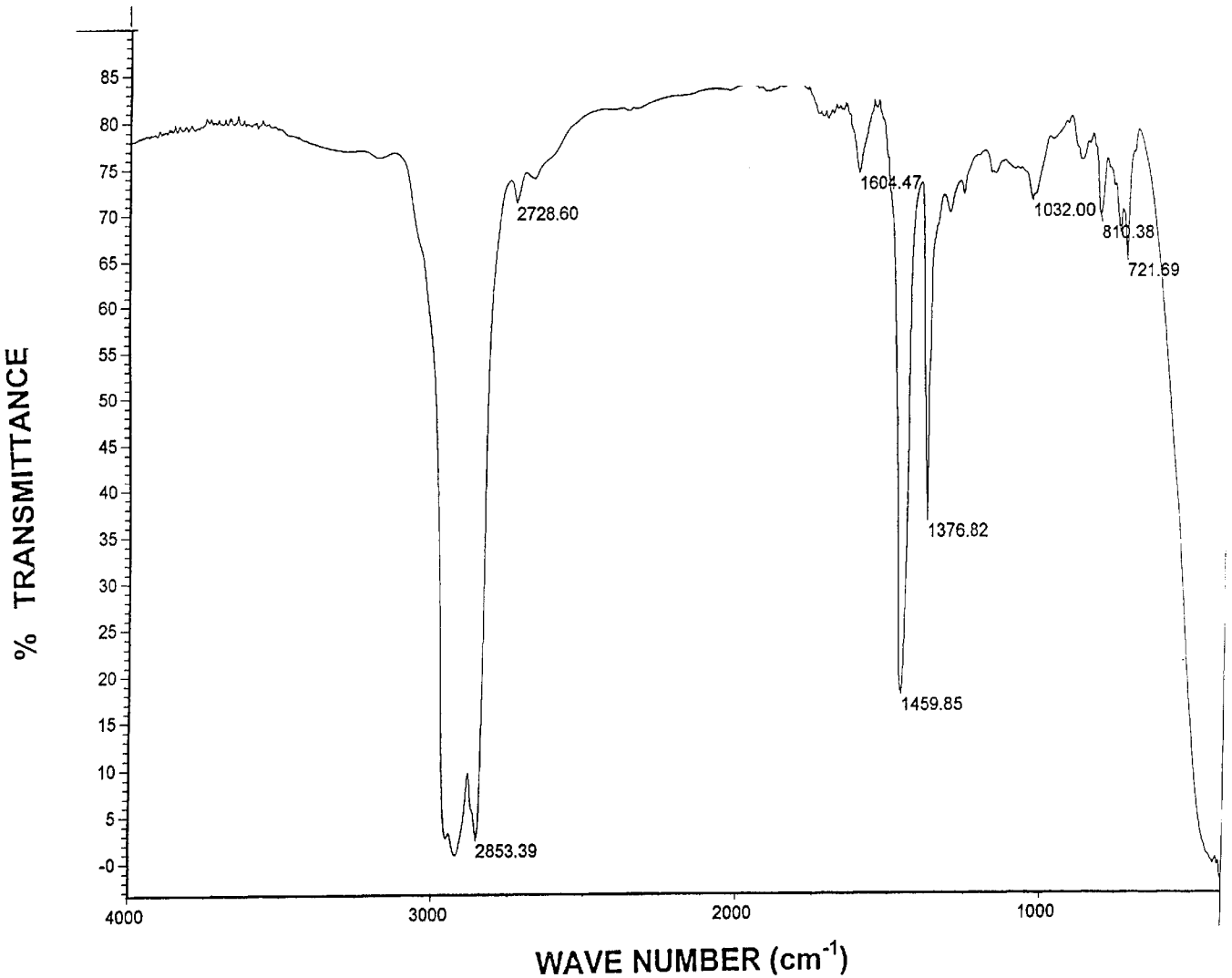
FIG. 8 attached is a FT-IR spectrum of products eluted from the spent iron oxide catalyst used in the oxidation reaction of organic compounds present in a stream of fossil hydrocarbons according to the invention.

The retained organic matter can be eluted from the catalyst with $CH_3Cl$ and concentrated by distillation, yielding a material the FT-IR analysis of which produces the spectrum illustrated in FIG. 8. The band between 3200–3700 $cm^{-1}$, characteristic of hydroxyl moieties such as alkyl alcohol and/or phenol compounds does not appear The significant set of bands between 3000–3100 $cm^{-1}$ shows the same set —C—H stretching vibrations of alkyl, alkenyl and/or aromatic ring observed in the DMF extract. Sharp and very intense bands at ~1460 $cm^{-1}$ and ~1380 $cm^{-1}$ and a smaller one at ~1605 $cm^{-1}$ indicated the presence of N-oxides and/or sulfoxides along with non-oxidized products such as disulfides or others in the spent iron-oxide. The intensities of these bands are as high as their equivalents in the DMF extract, indicating that the iron oxide may also act to adsorb some of the oxidized sulfur and nitrogen compounds.

As regards the analytic tools used in the assessment of the efficacy of removal of sulfur and nitrogen compounds from the treated hydrocarbon stream, the total nitrogen contents were determined by chemiluminescence according to the ANTEK method (ASTM D-5762); basic nitrogen contents were determined by potentiometric titration with $HClO_4$ (N-2373/UOP-269). The total sulfur content was determined by UV fluorescence (ASTM Method D-5354).

And the saturated, aromatic and olefin compound contents were determined by supercritical fluid chromatography measurements as defined by the ASTM Method D5186-91.

After the reaction the catalyst may be recycled, eluted for the removal of organic compounds or still it may be directed to any industrial use able to utilize the 40–60 weight % iron of the spent catalyst. One of such uses is to make up the feed of the metallurgical industry.

EXAMPLES

The following Examples illustrate the possibility of directing a product of the inventive process either to refining processes or to an end product ready for use. The Examples also illustrate the progress of experimental work in the optimization of the laboratory conditions designed for establishing the technique for removal of Sulfur and Nitrogen via limonite-catalyzed oxidation as well as a comparison with the classical, non-catalyzed oxidation. However, these should not be construed as limiting the invention.

Example 1

This Example illustrates that a simple brine extraction step prior to solvent extraction is enough to remove a substantial amount of nitrogen content. An additional extraction step with DMF was used as well.

In a round-bottomed 500 ml-flask provided with reflux, 3 g of limonite (25 mesh having ca. 45% weight Fe, from nickel ore mines located in Central Brazil) were added to 100 ml of light gasoil (187° C.~372° C.) produced by a delayed coking unit ($d_{20/4}$=0.862, $S_{total}$=5,500 ppm, $N_{total}$=2790 ppm, $N_{basic}$=2,535 pm), the mixture being kept under vigorous agitation for 15 min. Then 20 ml $H_2O_2$ 30% were added [Molar Ratio $H_2O_2$/(N+S)=6.6] and 4 ml formic acid analytical grade [HCOOH/(N+S) Molar Ratio=3.4], so that a mixture of pH=3.0 was produced, which was kept under vigorous agitation for 1.5 hours at room temperature. The product was filtered and neutralized until pH 6~7 with a saturated solution of NaOH. The oil phase was separated by decanting and submitted to extraction with 50 ml of brine (10 weight % NaCl) and then washed with distilled water, yielding an intermediate oil of $N_{total}$=1,530 ppm (62% removal) and $S_{total}$=5,000 ppm (2% removal) besides an aqueous phase as a stable suspension that slowly decanted. The remaining catalyst was washed with water and n-pentane and dried in an oven at 60° C. under vacuum, indicated a 7% weight increase. The intermediate oil was submitted to 1 hour of vigorous agitation with combined to anhydrous $MgSO_4$ and activated 3A molecular sieve (Baker) to remove residual water prior to solvent extraction. It was then washed with an equal volume of N,N'-dimetylformamide (DMF) analytical grade under vigorous agitation for 2 hours, an then with a NaCl solution (10 weight %) under agitation for 1 hours for the removal of residual solvent. Besides, the other phase, i.e. DMF-rich extract was washed twice with a NaCl (10 weight %) neutral solution also to remove DMF, and showed $N_{total}$=800 ppm and $N_{basic}$=160 ppm that is $N_{total}/N_{basic}$=5, while in the original oil $N_{total}/N_{basic}$=1.1, indicating that the extracted nitrogen compounds are mostly non-basic nitrogen compounds that lost the basicity due to oxidation. The treated end oil was dried over an activated 3A molecular sieve (Baker) and showed a clear yellowish color, $d_{20/4}$=0.81; $S_{total}$=2,290 ppm (55.1% overall removal), $N_{basic}$=185 ppm (92.7% overall removal), $N_{total}$=331.4 ppm (88.1% overall removal).

Example 2

This Example illustrates the simultaneous removal of sulfur an nitrogen compounds using more severe oxidation conditions as compared with Example 1. A better removal of sulfur compounds was observed even after brine extraction.

In a round-bottomed 500 ml-flask provided with reflux, 3 g of limonite (25 mesh having ca. 45% weight Fe, from nickel ore mines located in Central Brazil) were added to 100 ml of light gasoil produced by a delayed coking unit (187° C.~372° C., $d_{20/4}$=0.862, $S_{total}$=5,100 ppm, $N_{total}$=2,790 ppm, $N_{basic}$=2,535 pm), the mixture being kept under vigorous agitation for 15 min. Then 20 ml $H_2O_2$ 30% were added and 10 ml formic acid analytical grade [HCOOH/(N+S) Molar Ratio=8.6], so that a mixture of pH=2.0–3.0 was produced, which was kept under vigorous agitation for 30 minutes at room temperature and additional 20 ml $H_2O_2$ (30 weight %) were added, amounting to 40 ml [$H_2O_2$/(N+S) Molar Ratio=13.1]. The final mixture was kept under vigorous agitation for additional 1.5 hours. The flask was then cooled after ca. 1 hour in view of its exothermic character. The product was filtered and the pH was adjusted to 8~9 with NaOH saturated solution. The oil phase was separated and submitted to extraction with 50 ml brine (10 weight % NaCl) and then washed with distilled water, generating an intermediate oil having $N_{total}$=1,245 ppm (54% removal) an $S_{total}$=4,330 ppm (15% removal) besides an aqueous phase as a stable suspension that slowly decanted. The intermediate oil was vigorously agitated for 2 hours by contact with activated 3A molecular sieve (Baker) and washed with an equal volume of N,N'-dimetylformamide (DMF) analytical grade for 2 hours under vigorous agitation. Then it was washed with NaCl solution (10 weight %) for 1 hour under agitation for removal of residual solvent. The final treated oil was dried and showed $d_{20/4}$=0.80; $S_{total}$=1,199 ppm (76.5% overall removal), $N_{total}$=292 ppm (89.5% overall removal).

Example 3

This Example illustrates the process of the invention where a colloid is used to increase the removal of the sulfur and nitrogen compounds, keeping the amounts of peroxide, acid and catalyst of Example 1. This Example also illustrates that it is possible to obtain products suitable for further refining processes.

A temporary colloidal mixture of 150 ml of light gasoil (187° C.~372° C.) produced by a delayed coking unit ($d_{20/4}$=0.862, $S_{total}$=5,100 ppm, $N_{total}$=2,790 ppm, $N_{basic}$=2,535 pm) and 50 ml of a 0.25 weight % surfactant (nonylphenol ethoxylate) was prepared prior to the reaction. The colloidal mixture is called temporary since the amount and the kind of surfactant were chosen as to avoid coalescence of oil droplets before the completion of reaction time. In a round-bottomed 500 ml-flask provided with reflux, 3 g of limonite (25 mesh having ca. 45% weight Fe, from nickel ore mines located in Central Brazil) were added to the previously-prepared, the mixture being kept under vigorous agitation for 15 min. Then 10 ml $H_2O_2$ 30% were added [Molar Ratio $H_2O_2$/(N+S)=6.6] and 2 ml formic acid analytical grade [HCOOH/(N+S) Molar Ratio=3.4] and 1 ml of neutral 0.1M solution of $KH_2PO_4$/NaOH. The obtained mixture (pH=3.0) was kept under vigorous agitation for 1 hour at room temperature. Then the product was filtered, the pH was adjusted to 6~7 with a saturated NaOH solution. The oil phase was easily separated and extracted with 50 ml brine (10 weight % NaCl) and then washed with distilled water, producing an intermediate oil of $N_{total}$=936.2 ppm (66.4% removal) and $S_{total}$=4,815 ppm (5.6% removal). The intermediate oil was washed with an equal volume of N,N'-dimethylformamide (DMF) analytical grade for 2 hours under vigorous agitation and then washed with an equal volume of $KH_2PO_4$ 3% weight solution (pH=5.0) for 1 hour under agitation for removal of the residual solvent and washed with distilled water. The end oil was washed with activated molecular sieve 3A (Baker) and showed a yellowish clear color, $S_{total}$=1,522 ppm (70.2% overall removal) and $N_{total}$=173.7 ppm (93.8% overall removal).

Example 4

This Example is an additional illustration of the use of colloids to improve the removal of sulfur and nitrogen compounds according to the invention, using the same amounts of peroxide, acid and catalyst of Example 2.

A temporary colloidal mixture of 150 ml of light gasoil (187° C.~372° C.) produced by a delayed coking unit ($d_{20/4}$=0.862, $S_{total}$=5,100 ppm, $N_{total}$=2,790 ppm, $N_{basic}$=2,535 pm) and 50 ml of a 0.25 weight % surfactant (nonylphenol ethoxylate) was prepared prior to the reaction. The colloidal mixture was prepared similarly to that of Example 3. In a round-bottomed 500 ml-flask provided with reflux and cooling bath, 5 g of limonite (25 mesh having ca. 45% weight Fe, from nickel ore mines located in Central Brazil) were added to previously-prepared colloid, the mixture being kept under vigorous agitation for 15 min. Then 30 ml $H_2O_2$ 30 weight % were added and 15 ml formic acid analytical grade [HCOOH/(N+S) Molar Ratio=8.6] and 1.5 ml of neutral 0.1M solution of $KH_2PO_4$/NaOH. The obtained mixture (pH=3.0) was kept under vigorous agitation for 30 minutes at ambient temperature under cooling. Further 30 ml $H_2O_2$ 30 weight % were added so as to attain a molar ratio $H_2O_2$/(N+S)=13.1, and reacted for an additional 1.5 hour at temperatures varying between 23° C. to 60° C. due to self-heating. Then the product was filtered, the pH was adjusted to 9 with a saturated NaOH solution. The oil phase was very slowly separated and extracted with 100 ml brine (10 weight % NaCl) and then washed with distilled water, producing an oil of $N_{total}$=1,123 ppm (60% removal) and $S_{total}$=4,439 ppm (13% removal). The intermediate oil was vigorously agitated for 2 more hours with activated molecular sieves 3A (Baker) and after filtration, washed with an equal volume of N,N'-dimethylformamide (DMF) analytical grade for 2 hours under vigorous agitation and then washed with NaCl solution (10 weight %) for 1 hour under agitation for removal of the residual solvent. The end oil showed a yellowish clear color, $d_{20/4}$=0.78, $S_{total}$=1,243 ppm (75.6% overall removal) and $N_{total}$=235 ppm (91.6% overall removal).

Example 5

This Example illustrates the invention being applied to treat a fraction of shale oil.

In a round-bottomed 500 ml-flask provided with reflux, 5 g of limonite (25 mesh having ca. 45% weight Fe, from nickel ore mines located in Central Brazil) were added to 150 ml of shale oil (170° C.~395° C., $d_{20/4}$=0.92, $S_{total}$=8,400 ppm, $N_{total}$=8,600 ppm) the mixture being kept under vigorous agitation for 15 min. Then 20 ml $H_2O_2$ 30 weight % were added [Molar Ratio $H_2O_2$/(N+S)=2.2] and 10 ml formic acid analytical grade [HCOOH/(N+S) Molar Ratio=2.9] and 1.0 ml 10 weight % $CaCO_3$ solution. The obtained mixture (pH=3.0) was kept under vigorous agitation for 1.5 hours under cooling required to counteract the strong exothermic character. Then the product was filtered, the pH was adjusted to 9 with $Na_2SO_4$ 5 weight % solution. The oil phase was extracted with an equal volume of N,N'-dimethylformamide (DMF) and then washed with a phosphate buffer solution (pH=4~5). The obtained oil was then washed with water and dried with anhydrous $MgSO_4$, producing an oil of $N_{total}$=1,443 ppm (83.2% overall removal) and $S_{total}$=3,753 ppm (55.3% overall removal).

Example 6

This Example illustrates the effect of the catalyst granulometry. It shows that it is possible to use a lower peroxide than used in Example 5 and to obtain a better removal of N-containing compounds and a not so lower removal of S-containing compounds.

In a round-bottomed 500 ml-flask provided with reflux, added 100 ml of light gasoil (187° C.~372° C.) produced by a delayed coking unit ($d_{20/4}$=0.862, $S_{total}$=5,300 ppm, $N_{total}$=2,590 ppm, $N_{basic}$=2,346 ppm) 10 ml formic acid analytical grade [molar ratio HCOOH/(N+S)=8.8] and 1 ml $CaCO_3$ solution 10 weight %, the mixture being kept under vigorous agitation for 5 min. Then 3 g of limonite (80 mesh having ca. 45% weight Fe, from nickel ore mines located in Central Brazil) were added and the mixture was thoroughly agitated for 15 minutes. Then 15 ml $H_2O_2$ 30 weight % [Molar Ratio $H_2O_2$/(N+S)=5.0] were added. The obtained mixture (pH=3.0) was kept under vigorous agitation for 1.5 hour under ambient temperature controlled within 23<T<26° C. Then the product was filtered and neutralized with $Na_2SO_4$ 5 weight %. The oil phase was separated and extracted with 100 ml N,N'-dimethylformamide (DMF) analytical grade for 2 hours under vigorous agitation. The raffinate oil was washed with an equal volume of phosphate buffer solution (pH=4) for 1 hour under agitation for removal of residual solvent. The end treated oil was dried with anhydrous $MgSO_4$, producing an oil of $S_{total}$=1,333 ppm (74.9% removal) and $N_{total}$=146 ppm (94.4% removal). Then the oil was submitted to adsorption with silica-gel, the end oil showing a yellowish clear color, $d_{20/4}$=0.75, $S_{total}$=1,513 ppm (71.5% overall removal) and $N_{total}$=13.4 ppm (99.5% overall removal).

Example 7

This Example illustrates a double DMF extraction followed by an ethyl alcohol extraction.

Into a round-bottomed 500 ml-flask provided with reflux and cooling bath, were added 100 ml of light gasoil (162° C.~360° C.) produced by a delayed coking unit ($d_{20/4}$=0.861, $S_{total}$=5,300 ppm, $N_{total}$=2,590 ppm, $N_{basic}$=2,346 ppm) 10 ml formic acid analytical grade [molar ratio HCOOH/(N+S)=8.8], the mixture being kept under vigorous agitation for 5 min. Then 3 g of limonite (60 mesh having ca. 45% weight Fe, from nickel ore mines located in Central Brazil) were added and the mixture was thoroughly agitated for 15 minutes. Then 25 ml $H_2O_2$ 30 weight % [Molar Ratio $H_2O_2$/(N+S)=8.4] were added. The obtained mixture (pH=3.0) was kept under vigorous agitation for 1.5 hour under controlled temperature 23<T<26° C. Then the product was filtered. Then the oil phase was separated and extracted with 100 ml N,N'-dimethylformamide (DMF) analytical grade for 1 hour under vigorous agitation. The oil phase was separated and extracted with 50 ml N,N'-dimethylformamide (DMF) analytical grade for 1 hour under vigorous agitation. The raffinate oil was washed with an equal volume of phosphate buffer solution (pH=4) for 1 hour under agitation for removal of residual solvent. The so-obtained oil was extracted with 70 ml ethyl alcohol (95% vol/vol) for 1 hour under vigorous agitation. The treated oil was dried with anhydrous $MgSO_4$, producing an oil showing a strongly greenish, clear color, $d_{20/4}$=0.82, $S_{total}$=1,518 ppm (71.4% overall removal) and $N_{total}$=125.3 ppm (95.2% overall removal).

Example 8

This Example illustrates the use of an exclusive ethyl alcohol extraction followed by adsorption with silica gel. This Example was focused on the production of a feedstock for further refining process.

The feed was a gasoil made up of heavy diesel, LCO (Light Cycle Oil) and coke light gasoil having the following end features: $d_{20/4}$=0.882, $S_{total}$=4,837 ppm $N_{total}$=1,587 ppm and distillation range 139–473° C.

Into a round-bottomed 500 ml-flask provided with reflux and cooling bath, were added 100 ml of the above feed and 10 ml formic acid analytical grade [molar ratio HCOOH/(N+S)=11.1], the mixture being kept under vigorous agitation for 5 min. Then 3 g of limonite (60 mesh having ca. 45% weight Fe, from nickel ore mines located in Central Brazil) were added and the mixture was thoroughly agitated for 15 minutes. Then 20 ml $H_2O_2$ 30 weight % [Molar Ratio $H_2O_2$/(N+S)=8.5] were added. The obtained mixture (pH=3.0) was kept under vigorous agitation for 1.5 hour under controlled temperature 20<T<23° C. Then the product was filtered. Then the oil phase was separated and extracted with 50 ml ethyl alcohol (95% vol) for 1 hour under vigorous agitation. The collected oil phase had 95 ml volume and was extracted again with 50 ml ethyl alcohol (95% vol ) for 1 additional hour under vigorous agitation. The oil phase was collected, producing an intermediate product A of 90 ml volume having, $S_{total}$=2,287 ppm (52.7% removal), $N_{total}$=280.6 ppm (82.3% removal). The oil phase was then washed with an equal volume of distilled water for 1 hour under vigorous agitation and for 2 hours under agitation with an activated molecular sieve 3A (Baker) resulting in an intermediate product B having ethyl alcohol and water contents <0.5 mass %, $S_{total}$=1,819 ppm (62.4% overall removal), $N_{total}$=184.6 ppm (88.4% overall removal). This oil was submitted to adsorption with silica-gel, resulting in a clear yellow, slightly greenish end product $d_{20/4}$=0.86, $S_{total}$=1,545 ppm (71.4% overall removal) and $N_{total}$=68.2 ppm (95.7% overall removal).

Example 9

This Example illustrates a reaction comprising a first step with inorganic acid followed by a step with organic acid. DMF extraction, followed by silica-gel adsorption, was used. The obtained products can be directed to further refining processes. The extent of removal is higher than in previous Examples.

Into a round-bottomed 500 ml-flask provided with reflux and no cooling means 100 ml of light gasoil from a delayed coking process ($d_{20/4}$=0.861, $S_{tota1}$=5,300 ppm, $N_{tota1}$=2,590 ppm, $N_{basic}$=2,346 ppm, 162–360° C.) and 3 g of limonite (60 mesh having ca. 45% weight Fe, from nickel ore mines located in Central Brazil) were added, the mixture being kept under vigorous agitation for 15 min. Then 10 ml phosphate buffer solution (pH=3) were added and the mixture was thoroughly agitated for more 15 minutes. Then 10 ml $H_2O_2$ 30 weight % were added and the mixture (of pH=5) was thoroughly agitated for 1 hour at a temperature between 20° C. and 24° C. Then 10 ml formic acid analytical grade [molar ratio HCOOH/(N+S)=8.8] and additional 20 ml $H_2O_2$ 30 weight % so that the final molar ratio $H_2O_2$/(N+S)=10.1 and the mixture was thoroughly agitated for 1 hour under temperature between 24 and 31° C. caused by self-heating of the reaction system. Then the product was filtered. The oil phase (95 ml) was separated and extracted with 100 ml N,N'-dimethylformamide (DMF) analytical grade for 1 hour under vigorous agitation. The collected oil phase (77 ml volume) was washed with an equal volume of phosphate buffer solution (pH=3) for 1 hour under vigorous agitation for removal of residual solvent and dried with anhydrous $MgSO_4$ yielding an intermediate product of $S_{total}$=1,286 ppm (75.7% removal), $N_{total}$=84.5 ppm (96.7% removal). This intermediate oil was submitted to adsorption with silica-gel, resulting in a clear slightly yellowish end product $d_{20/4}$=0.79, $S_{total}$=1,230 ppm (76.8% overall removal) and $N_{total}$=47.1 ppm (98.2% overall removal).

Example 10

This Example illustrates an optimized set of reaction conditions using as feed a gasoil from delayed coking process and therefore an olefin-rich feed. Inorganic acid is combined to organic acid. This mode results in a higher degree of removal of sulfur and nitrogen compounds as well as eliminating olefins.

Into a round-bottomed 500 ml-flask provided with reflux and no cooling means 200 ml of light gasoil from a delayed coking process ($d_{20/4}$=0.861, $S_{total}$=5,300 ppm, $N_{total}$=2,590 ppm, $N_{basic}$=2,346 ppm, 162–360° C., saturated compounds 47.3 weight %, olefins 20 weight %, aromatics 33.1 weight %) and 3 g of limonite (150 mesh having ca. 45% weight Fe, from nickel ore mines located in Central Brazil) were added, the mixture being kept under vigorous agitation for 15 min. Then 0.5 ml $H_3PO_4$ analytical grade were added, leading to pH 5~6 and the mixture was thoroughly agitated for more 15 minutes. Then 10 ml $H_2O_2$ 50 weight % were added and the mixture (of pH=5) was thoroughly agitated for 1 hour at a temperature that started at 23° C. and ended at 32° C. caused by self-heating. Then 10 ml formic acid analytical grade [molar ratio HCOOH/(N+S)=8.8] and additional 3 g limonite (150 mesh) and more 10 ml $H_2O_2$ 50 weight % so that the final molar ratio $H_2O_2$/(N+S)=11.2 and the mixture at pH=3 was thoroughly agitated for 1 hour under temperature starting at 32° C. and ending at 97.5° C. caused by self-heating due to the strong exothermal character of the reaction system after 23 minutes, and then at ambient temperature until the end of the reaction. Then the product was filtered and the oil phase was separated and presented 50,3 weight % less olefins than in the original feedstock. The oil phase was extracted with 100 ml N,N'-dimethylformamide (DMF) analytical grade for 1 hour under vigorous agitation. The collected oil phase was washed with an equal volume of phosphate buffer solution (pH=3) for 1 hour under vigorous agitation for removal of residual solvent and dried with anhydrous $MgSO_4$ yielding an intermediate product of $S_{total}$=796 ppm (85% removal), $N_{total}$=81.5 ppm (96.9% overall removal). This intermediate oil was submitted to adsorption with silica-gel, resulting in a clear end product $d_{20/4}$=0.78, $S_{total}$=662 ppm (87.5% overall removal) and $N_{total}$=10 ppm (99.6% overall removal).

Example 11

This Example illustrates optimized reaction conditions using a feedstock mostly composed of a direct atmospheric direct distillation feedstock. Inorganic acid is combined to organic acid, with deeply removal of sulfur and nitrogen compounds as well as olefin withdrawal.

Into a round-bottomed 500 ml-flask provided with reflux and no cooling means 200 ml of a gasoil made up of heavy diesel (60% vol/vol), "light cycle oil" (14% vol/vol) and light gasoil from a delayed coking process (26 vol/vol %) having the following overall features: $d_{20/4}$=0.882, $S_{total}$=4,837 ppm, $N_{total}$=1,587 ppm, 139–473° C., saturated compounds 51 weight %, olefins 7 weight %, aromatics 41.6 weight %). Then 1 ml $H_3PO_4$ analytical grade was added, 10 ml formic acid analytical grade HCOOH/(N+S)=5.7 and 25 ml $H_2O_2$ 50 weight % $H_2O_2$/(N+S)=9.1, the mixture being kept under agitation for 5 minutes. Then 6 g of limonite (150 mesh having ca. 45% weight Fe, from nickel ore mines located in Central Brazil), 5 ml formic acid analytical grade so as to attain HCOOH/(N+S) molar ratio=8.5 and 10 ml aqueous $H_2O_2$ 50 weight % so as to attain $H_2O_2$/(N+S)=10.9 were added, the mixture being kept under vigorous agitation for 1 hour (at pH 2~3) at a temperature starting at 23° C. and reaching 98° C. after 30 minutes caused by self-heating due to the strong exothermal character of the reaction system and then dropped to 35° C. until the end of the period. The reaction mixture was allowed to be agitated for an additional hour in presence of an additional amount of 6 g fresh limonite (150 mesh) until the temperature of 35° C. be dropped to ambient temperature. Then the product was filtered and the oil phase was separated and presented 55,7 weight % less olefins than in the original feedstock. The oil phase was extracted with an equal volume of N,N'-dimethylformamide (DMF) analytical grade for 1 hour under vigorous agitation. The collected oil phase was washed with an equal volume of phosphate buffer solution (pH=3) for 1 hour under vigorous agitation for removal of residual solvent and dried with anhydrous $MgSO_4$ followed by adsorption with silica gel yielding a clear end product $d_{20/4}$=0.80, $S_{total}$=145 ppm (97.0% overall removal) and $N_{total}$=5 ppm (99.7% overall removal).

Comparative Examples

The oxidation treatment of published EP0565324 reports that sulfur compounds from petroleum related products are oxidized by the mixture of said oil with $H_2O_2$ and formic acid exclusively, that is, without the solid catalyst as in the present application and then removed by extraction and adsorption so as to reduce the sulfur content of the feed. However such publication does not mention at all the oxidation and removal of nitrogen compounds nor the oxidation or removal of olefin compounds.

This way, the oxidation conditions without the use of a solid catalyst were practiced in the present invention to treat the feeds used herein, so that data were generated for comparing not only the degree of sulfur removal as well as the degree of removal of compounds that had not been considered in that publication, that is, the degree of removal of nitrogen of the end product as well as the olefin compounds of the post-oxidized product.

For the purposes of comparison, two feedstocks of different chemical characteristics have been tested:

Feedstock 1: A fossil oil of distillation range 162–360° C. made up of gasoil that is a by-product of the delayed coking of petroleum vacuum residue. The features of said feedstock are: ($d_{20/4}$=0.861, $S_{total}$=5,300 ppm, $N_{total}$=2,590 ppm, $N_{basic}$=2,346 ppm, saturated compounds 47.3 weight %, olefins 20 weight %, aromatics 33.1 weight %)

Feedstock 2: A fossil petroleum oil of distillation range 139–473° C., made up of heavy diesel from direct atmospheric distillation (60% vol/vol), "light cycle oil" (14% vol/vol) and light gasoil from a delayed coking process (26 vol/vol %) having the following overall features: $d_{20/4}$=0.882, $S_{total}$=4,837 ppm, $N_{total}$=1,587 ppm, saturated compounds 51 weight %, olefins 7 weight %, aromatics 41.6 weight %).

Comparative examples are listed in the following TABLE, where reaction conditions similar to those practiced in the invention except for the absence of iron oxide show that the process using the limonite iron oxide catalyst in an oil medium yields improved results:

1. For a gasoil (Feedstock 1) from a thermal conversion of petroleum residua, air such as the delayed coking process, the degree of removal of sulfur, nitrogen and olefin compounds in the case catalyzed by limonite iron oxide are all superior to the degree reached by the state-of-the-art experiments where no solid catalyst is used;
2. For a gasoil (Feedstock 2) made up mainly of a product from direct petroleum distillation, high degrees of nitrogen removal are obtained in both cases, but more pronounced when using the limonite iron oxide catalyst. The levels of removal of olefinic unsaturations are also similar and slightly superior to the results with Feedstock 1, this latter feed being richer in olefins.

State of the art non-catalytic oxidation tests were conduced by pouring the oil feedstock over a solution of HCOOH and $H_2O_2$ (50 weight % in water) previously mixed under agitation for 15 min at a molar ratio of HCOOH/$H_2O_2$=1.6. The resulted liquid was submitted to a vigorous agitation for 1 h at 30° C. and then heated to 60° C. to be reacting for more 1 h. Post-reaction procedures were the same as for the catalytic case.

COMPARATIVE TABLE

| Comparison Parameters | Feedstock I Treatment (100% Delayed Coking Gasoil | | | Feedstock II Treatment Heavy Diesel from direct distillation (60%) + LCO (14%) + Delayed Coking Gasoil (26%) | | |
|---|---|---|---|---|---|---|
| | Feed I | Invention | State-of-the-art[a] | Feed II | Invention | State-of-the-art[a] |
| Total Nitrogen (ppm) (Feed and end product) | 2,590 | 10 | 27.5 | 1,587 | 5 | 8 |
| Total Nitrogen Removal (%) | | 99.6 | 98.9 | | 99.7 | 99.5 |
| Total Sulfur (ppm) (Feed and end product) | 5,300 | 662 | 1,012 | 4,837 | 145 | 142 |
| Total Sulfur Removal (%) | | 87.5 | 80.9 | | 97 | 97.1 |
| Olefins (% w/w)[b] (Feed and Post-oxidized product) | 19.6 | 9.7 | 11.1 | 7.0 | 3.1 | 3.2 |
| Saturated c. (% w/w)[b] (Feed and Post-oxidized product) | 47.3 | 54.8 | 53.6 | 51.4 | 55.9 | 56.7 |
| Aromatics (% w/w)[b] (Feed and Post-oxidized product) | 33.1 | 35.5 | 34.0 | 41.6 | 41.0 | 40.1 |
| Olefin Removal (%) | | 50.3 | 43.1 | | 55.7 | 54.3 |

([a]) It should be borne in mind that a main difference between the state-of-the-art process and the invention is that the non-catalytic, state-of-the-art process requires heating of at least 60° C. to reach suitable oxidation levels, while the inventive process using limonite iron oxide reaches the same or better oxidation and removal levels without any heating.

-continued

COMPARATIVE TABLE

| Comparison Parameters | Feedstock I Treatment (100% Delayed Coking Gasoil | | | Feedstock II Treatment Heavy Diesel from direct distillation (60%) + LCO (14%) + Delayed Coking Gasoil (26%) | | |
|---|---|---|---|---|---|---|
| | Feed I | Invention | State-of-the-art[a] | Feed II | Invention | State-of-the-art[a] |

([b]) Olefins, saturated and aromatic contents in the post-oxidized oil, that is the oil product prior to any washing, extraction or adsorption.

I claim:

1. A process for the catalytic oxidation of sulfur, nitrogen and unsaturated compounds from fossil hydrocarbon streams contaminated with said compounds, the process comprising the following steps:

a) Providing a pulverized raw iron oxide;

b) Providing at least one organic acid c) Providing at least one peroxide;

d) Oxidizing unsaturated compounds as well as sulfur and nitrogen contaminants by admixing, under atmospheric pressure and equal or higher than ambient temperature, under agitation, said organic acid and said hydrocarbon stream contaminated with sulfur, nitrogen and unsaturated compounds and then said peroxide, so as to obtain a peracid, the molar amount of peroxide and organic acid relative to the sum of the nitrogen and sulfur contents present in the hydrocarbon stream being at least 3.0, at pH between 2.0 and 6.0, for the required period to obtain a hydrocarbon stream where the unsaturated, sulfur and nitrogen contaminants have been partially oxidized;

e) Further oxidizing said unsaturated compounds as well as sulfur and nitrogen contaminants in the presence of oxidant hydroxyl radicals generated by adding to said partially oxidized hydrocarbon stream, under atmospheric pressure and equal or higher than ambient temperature, the higher than ambient temperature being generated by the process itself, under agitation, a catalytic amount of said pulverized iron oxide so as to obtain a slurry of iron oxide, hydrocarbon stream and oxidized unsaturated, sulfur and nitrogen compounds, the reaction conditions being kept during 1–2 hours and an acidic pH between 2.0 and 6.0;

f) After the end of the reaction, filtrating the reaction medium containing an aqueous phase and a hydrocarbon phase, and separating the spent iron oxide catalyst;

g) Decanting in order to separate the aqueous phase;

h) Correcting the pH of the resulting hydrocarbon phase to values between 6.1 and 9.0 and recovering the hydrocarbon phase;

i) Post-treating the hydrocarbon phase to extract the oxidized products at the desired level; and j) Recovering the post-treated hydrocarbon phase having sulfur compounds in the range of 0.01 weight % and 0.2 weight % and nitrogen compounds in the range of 0.001 weight % to 0.15 weight %, the final olefin content being up to 50% of the original olefin content.

2. A process for the removal of sulfur, nitrogen and unsaturated compounds from fossil hydrocarbon streams contaminated with said compounds through catalytic oxidation, wherein said process comprises the following steps:

a) Providing a pulverized raw iron oxide;

b) Providing at least one organic acid;

c) Providing at least one peroxide;

d) Oxidizing unsaturated compounds as well as sulfur and nitrogen contaminants by admixing, under atmospheric pressure and equal or higher than ambient temperature, under agitation, said organic acid and said hydrocarbon stream contaminated with sulfur, nitrogen and unsaturated compounds and then said peroxide, so as to obtain a peracid, the molar amount of peroxide and organic acid relative to the sum of the nitrogen and sulfur contents present in the hydrocarbon stream being at least 3.0, at pH between 2.0 and 6.0, for the required period to obtain a hydrocarbon stream where the unsaturated, sulfur and nitrogen contaminants have been partially oxidized;

e) Further oxidizing said unsaturated compounds as well as sulfur and nitrogen contaminants in the presence of oxidant hydroxyl radicals generated by adding to said partially oxidized hydrocarbon stream, under atmospheric pressure and equal or higher than ambient temperature, the higher than ambient temperature being generated by the process itself, under agitation, a catalytic amount of said pulverized raw iron oxide so as to obtain a slurry of iron oxide, hydrocarbon stream and oxidized unsaturated, sulfur and nitrogen compounds, the reaction conditions being kept during 1–2 hours and an acidic pH between 2.0 and 6.0;

f) After the end of the reaction, filtrating the reaction medium containing an aqueous phase and a hydrocarbon phase, and separating the spent iron oxide catalyst;

g) Decanting in order to separate the aqueous phase;

h) Correcting the pH of the resulting hydrocarbon phase to values between 6.1 and 9.0 and recovering the hydrocarbon phase;

i) Post-treating the hydrocarbon phase to extract/remove the oxidized products at the desired level; and j) Recovering the post-treated hydrocarbon phase having sulfur compounds in the range of 0.01 weight %and 0.2 weight % and nitrogen compounds in the range of 0.001 weight % to 0.15 weight %, the final olefin content being up to 50% of the original olefin content.

3. A process for obtaining a hydrocarbon stream suitable for refining processes through the catalytic oxidation of same hydrocarbon stream contaminated with sulfur, nitrogen and unsaturated compounds, wherein said process comprises the following steps:

a) Providing a pulverized raw iron oxide;

b) Providing at least one organic acid;

c) Providing at least one peroxide;

d) Oxidizing unsaturated compounds as well as sulfur and nitrogen contaminants by admixing, under atmospheric pressure and equal or higher than ambient temperature, under agitation, said organic acid and said hydrocarbon stream contaminated with sulfur, nitrogen and unsaturated compounds and then said peroxide, so as to obtain a peracid, the molar amount of peroxide and organic acid relative to the sum of the nitrogen and sulfur contents present in the hydrocarbon stream being at least 3.0, at pH between 2.0 and 6.0, for the required period to obtain a hydrocarbon stream where the unsaturated, sulfur and nitrogen contaminants have been partially oxidized;

e) Further oxidizing said unsaturated compounds as well as sulfur and nitrogen contaminants in the presence of oxidant hydroxyl radicals generated by adding to said partially oxidized hydrocarbon stream, under atmospheric pressure and equal or higher than ambient temperature, the higher than ambient temperature being generated by the process itself, under agitation, a catalytic amount of said pulverized raw iron oxide so as to obtain a slurry of iron oxide, hydrocarbon stream and oxidized unsaturated, sulfur and nitrogen compounds, the reaction conditions being kept during 1–2 hours and an acidic pH between 2.0 and 6.0;

f) After the end of the reaction, filtrating the reaction medium containing an aqueous phase and a hydrocarbon phase, and separating the spent iron oxide catalyst;

g) Decanting in order to separate the aqueous phase;

h) Correcting the pH of the resulting hydrocarbon phase to values between 6.1 and 9.0 and recovering the hydrocarbon phase;

i) Post-treating the hydrocarbon phase to extract the oxidized products at the desired level; and j) Recovering the post-treated hydrocarbon phase suitable for further refining having nitrogen compounds less than 0.1 weight % and mass balance yields of the order of 80–90 weight %.

4. A process for obtaining a deeply desulfurized and deeply denitrified product through the catalytic oxidation of a hydrocarbon stream containing sulfur, nitrogen and unsaturated contaminants, wherein said process comprises the following steps:

a) Providing a pulverized raw iron oxide;

b) Providing at least one organic acid;

c) Providing at least one peroxide;

d) Oxidizing unsaturated compounds as well as sulfur and nitrogen contaminants by admixing, under atmospheric pressure and equal or higher than ambient temperature, under agitation, said organic acid and said hydrocarbon stream contaminated with sulfur, nitrogen and unsaturated compounds and then said peroxide, so as to obtain a peracid, the molar amount of peroxide and organic acid relative to the sum of the nitrogen and sulfur contents present in the hydrocarbon stream being at least 3.0, at pH between 2.0 and 6.0, for the required period to obtain a hydrocarbon stream where the unsaturated, sulfur and nitrogen contaminants have been partially oxidized;

e) Further oxidizing said unsaturated compounds as well as sulfur and nitrogen contaminants in the presence of oxidant hydroxyl radicals generated by adding to said partially oxidized hydrocarbon stream, under atmospheric pressure and equal or higher than ambient temperature, the higher than ambient temperature being generated by the process itself, under agitation, a catalytic amount of said pulverized raw iron oxide so as to obtain a slurry of iron oxide, hydrocarbon stream and oxidized unsaturated, sulfur and nitrogen compounds, the reaction conditions being kept during 1–2 hours and an acidic pH between 2.0 and 6.0;

f) After the end of the reaction, filtrating the reaction medium containing an aqueous phase and a hydrocarbon phase, and separating the spent iron oxide catalyst;

g) Decanting in order to separate the aqueous phase;

h) Correcting the pH of the resulting hydrocarbon phase to values between 6.1 and 9.0 and recovering the hydrocarbon phase;

i) Post-treating the hydrocarbon phase to extract the oxidized products at the desired level; and j) Recovering the post-treated, deeply desulfurized and deeply denitrified product having sulfur compounds less than 0.015 weight % (150 ppm) and nitrogen compounds less than 0.001 weight % (10 ppm), the final olefin content being up to 50% of the original olefin content and mass balance yields of the order of 50 weight %.

5. A process according to claims 1, 2, 3 or 4 wherein the hydrocarbon stream comprises a raw petroleum oil or its heavy fractions, alone or admixed in any amount, fuels, lubricants, raw or fractionated shale oil and its fractions alone or admixed in any amounts, liquid coal oil and related products, oil sands and related products.

6. A process according to claims 1, 2, 3 or 4, wherein the End Boiling Point (EBP) of the hydrocarbon stream is about 500° C.

7. A process according to claims 1, 2, 3 or 4, wherein the hydrocarbon,streams contain up to 2.0 weight % total S and up to 2.0 weight % total N for petroleum-derived streams and shale oil and related-derived streams as well as up to 40 weight % of unsaturated compounds as mono-, di- and polyolefins, open-chained and cyclic.

8. A process according to claims 1, 2, 3 or 4, wherein the at least one peroxide is an organic peroxide selected from the group consisting of an alkyl hydroperoxide and an acyl hydroperoxide of formula ROOH, wherein R is alkyl, $H_{n+2}C_nC(=O)$—(n>=1), HC(=O)—, Aryl-C(=O)—.

9. A process according to claims 1, 2, 3 or 4, wherein the at least one peroxide is an inorganic peroxide consisting of hydrogen peroxide $H_2O_2$.

10. A process according to claims 1, 2, 3 or 4, wherein the peroxide is a mixture of organic and inorganic peroxide in any amount.

11. A process according to claims 1, 2, 3 or 4, wherein the at least one acid is an organic acid selected from the group consisting of a carboxylic acid, a dicarboxylic acid and a polycarboxylic acid.

12. A process according to claim 11, wherein the organic acid is formic acid, acetic acid, $X_mCH_{3-m}COOH$ (m=1~3, X=F, Cl, Br).

13. A process according to claim 14, wherein the inorganic acid is selected from the group consisting of phosphoric acid, carbonic acid and buffer solutions thereof.

14. A process according to claim 1, wherein the organic acid is added in combination with an inorganic acid.

15. A process according to claims 1, 2, 3 or 4, wherein alternatively the order of addition of the components for the catalytic oxidation is the hydrocarbon stream followed by organic acid, then by the pulverized raw iron oxide to obtain a slurry of iron oxide in the hydrocarbon stream and at least one peroxide.

16. A process according to claims 1, 2, 3 or 4, wherein alternatively the order of addition of the components for the catalytic oxidation is the hydrocarbon stream to which is added inorganic acid, followed by the raw iron oxide to obtain a slurry of iron oxide in the hydrocarbon stream, then organic acid and at least one peroxide.

17. A process according to claims 1, 2, 3 or 4, wherein alternatively the order of addition of the components for the catalytic oxidation is the hydrocarbon stream to which is added at least one peroxide, followed by at least an organic acid and iron oxide.

18. A process according to claims 1, 2, 3 or 4, wherein alternatively the order of addition of the components for the catalytic oxidation is at least an organic acid and at least one peroxide admixed under agitation, followed by the hydrocarbon stream and the pulverized raw iron oxide.

19. A process according to claims 1, 2, 3 or 4, wherein alternatively the order of addition of the components for the catalytic oxidation is the hydrocarbon stream to which is added the pulverized raw iron oxide and a peracid.

20. A process according to claims 1, 2, 3 or 4, wherein alternatively the order of addition of the components for the catalytic oxidation is the hydrocarbon stream to which is added the pulverized iron oxide and then at least an inorganic acid and a peracid.

21. A process according to claims 1, 2, 3 or 4, wherein alternatively all the components for the catalytic oxidation are admixed and introduced simultaneously into the hydrocarbon stream.

22. A process according to claims 1, 2, 3 or 4, wherein the temperature of said process is of between 20° C. and 100°0 C. in the absence of any added external heating.

23. A process according to claims 1, 2, 3 or 4, wherein the iron oxide compound is selected from the group consisting of amorphous, crystalline and semicrystalline forms of iron oxide compounds.

24. A process according to claims 1, 2, 3 or 4, wherein the pulverized raw iron oxide comprises iron oxyhydroxide of formula FeOOH.

25. A process according to claims 1, 2, 3 or 4, wherein the pulverized raw iron oxide comprises hydrated iron oxyhydroxide of formula $FeOOH_{,n}H_2O$.

26. A process according to claim 25, wherein the iron oxyhydroxide is a crystalline iron oxyhydroxide selected from the group consisting of α-FeOOH (Goethite), γ-FeOOH (Lepidocrocite), β-FeOOH (Akaganeite), and δ'-FeOOH (Ferroxyhite).

27. A process according to claim 26, wherein the iron oxyhydroxide crystals are embedded in a limonite ore matrix the iron content of which is 40–60 weight percent.

28. A process according to claim 27, wherein the granulometry of the particles of the limonite ore is such that the size of said particles is equal or smaller than 0.71 mm (25 mesh Tyler).

29. A process according to claim 27, wherein the granulometry of the particles of the limonite ore is such that the size of said particles is equal or smaller than 0.25 mm (60 mesh Tyler).

30. A process according to claim 27, wherein the granulometry of the particles of the limonite ore is such that the size of said particles is equal or smaller than 0.04 mm (=5 mesh Tyler).

31. A process according to claims 1, 2, 3, or 4, wherein the amount of pulverized raw iron oxide catalyst is of from 0.01 to 5.0 weight %, based on the amount of hydrocarbon stream being submitted to said process.

32. A process according to claims 1, 2, 3, or 4, wherein the amount of iron oxide catalyst is of from 1.0 to 3.0 weight %, based on the amount of hydrocarbon stream being submitted to said process.

33. A process according to claim 1, 2, 3 or 4, wherein the spent iron oxidation catalyst separated at the end of the reaction is recycled.

34. A process according to claims 1, 2, 3 or 4, wherein the spent iron oxidation catalyst separated at the end of the reaction is eluted for the removal of the oxidized organic compounds.

35. A process according to claims 1, 2, 3 or 4, wherein the post treating step j) comprises extracting the oxidized compounds from the hydrocarbon phase with water.

36. A process according to claims 1, 2, 3 and 4, wherein the post treating step j) comprises extracting the oxidized compounds from the hydrocarbon phase with an aqueous solution of up to 10 weight % NaCl brine.

37. A process according to claims 1, 2, 3 or 4, wherein the post treating step j) comprises extracting the oxidized compounds from the hydrocarbon phase with an aprotic polar solvent.

38. A process according to claim 37, wherein the aprotic polar solvent is N,N'-dimethylformamide, N,N'-dimethylsulfoxide, N-methylpyrrolidone, N,N'-dimethylacetamide, acetonitrile, trialkylphosphates, nitromethane, methyl alcohol, ethyl alcohol, furfural, alone or admixed in any amounts.

39. A process according to claims 1, 2, 3 or 4, wherein the molar amount of peroxide is at least 2.0 relative to the sum of the nitrogen and sulfur contents present in the hydrocarbon stream.

40. A process according to claims 1, 2, 3 or 4, wherein the extraction step j) comprises adsorption of the oxidized compounds on an adsorbent.

41. A process according to claim 40, wherein the adsorbent is alumina.

42. A process according to claim 40, wherein the adsorbent is silica-gel.

43. A process according to claim 13, wherein the organic acid is added after an inorganic acid.

44. A process according to claim 6, wherein the hydrocarbon stream is selected from the group consisting of gasoil streams, medium distillates, and mixtures thereof.

* * * * *